US006264526B1

(12) United States Patent
Meeker

(10) Patent No.: US 6,264,526 B1
(45) Date of Patent: Jul. 24, 2001

(54) SHAPE TRANSFORMABLE STUFFED ANIMALS

(76) Inventor: Donald W. Meeker, 750 La Playa, #512, San Francisco, CA (US) 94121

( * ) Notice: Subject to any disclaimer, the term of this patent is extended or adjusted under 35 U.S.C. 154(b) by 0 days.

(21) Appl. No.: 09/616,578

(22) Filed: Jul. 14, 2000

Related U.S. Application Data

(60) Provisional application No. 60/143,715, filed on Jul. 14, 1999.

(51) Int. Cl.[7] ..... A63H 3/02; A63H 3/04

(52) U.S. Cl. ..... 446/369; 446/385

(58) Field of Search ..... 446/320, 369, 446/370, 385

(56) References Cited

U.S. PATENT DOCUMENTS

| | | | | |
|---|---|---|---|---|
| 1,292,789 | * | 1/1919 | Jack | 446/369 |
| 3,448,539 | * | 6/1969 | Hartpence | 446/370 X |
| 4,505,687 | * | 3/1985 | Munro | 446/385 |
| 4,755,190 | * | 7/1988 | Autore | 446/369 |
| 4,884,991 | * | 12/1989 | Terzian | 446/369 |
| 5,194,033 | * | 3/1993 | Wright | 446/369 X |

FOREIGN PATENT DOCUMENTS

| | | | | |
|---|---|---|---|---|
| 316158 | * | 5/1989 | (EP) | 446/385 |
| 2364676 | * | 5/1978 | (FR) | 446/385 |
| 2639840 | * | 6/1990 | (FR) | 446/369 |
| 2110098 | * | 6/1983 | (GB) | 446/369 |
| 424822 | * | 9/1947 | (IT) | 446/369 |

* cited by examiner

*Primary Examiner*—John A. Ricci

(57) ABSTRACT

A resilient covering houses an air filled coiled flexible stuffing material maintaining the shape of the covering in the form of a stuffed toy. Applying a force to the stuffed toy distorts the shape of the stuffing material changing the air content to change the shape of the stuffed toy. Releasing the force permits the stuffing material to resume its original shape and air content, restoring the shape of the stuffed toy. An elongated insert, normally coiled and straightenable by snapping the ends, is inserted in one embodiment for a roll-up stuffed toy which can be snapped into a rigid straight configuration. Another embodiment with an elasticized covering enables the stuffed toy to be stretched. Mating hook and loop fasteners at the extremities enable the stuffed toy to be stretched around objects and secured in place.

11 Claims, 3 Drawing Sheets

SHAPE TRANSFORMABLE STUFFED ANIMALS

CLAIM OF PROVISIONAL APPLICATION RIGHTS

This application claims the benefit of U.S. Provisional Patent Application No. 60/143,715, filed on Jul. 14, 1999.

BACKGROUND OF THE INVENTION

1. Field of the Invention

The present invention relates to stuffed animal figures, and in particular to stuffed animal figures having a stuffing material enabling their shape to be transformed in various ways.

2. Description of the Prior Art

Stuffed animal figures are very popular among children and adults as playthings and as collectibles. Their soft physical cuddly quality and generally cute, humorous, friendly or other appealing appearance bring enjoyment and comfort to their owners.

Most prior art stuffed animal figures are stuffed full with various types of stuffing inside an outer material which retains the stuffing and defines the outer appearance, while the inside stuffing maintains the figures in a particular shape. While the components of the figures are generally movable they are not transformable in shape to any great extent.

Most prior art stuffed animal figures occupy a definite volume due to the amount of stuffing inside, which volume may not be altered to any great extent. The figures, therefore, occupy a certain amount of space and require that amount of space for using or storing the figures.

Most prior art stuffed animal figures cannot be compressed into a smaller shape occupying less space, nor can they be stretched to be greater in length, nor can they be formed into other shapes having a play value.

SUMMARY OF THE INVENTION

An object of the present invention is to provide a stuffed animal figure with a highly resilient stuffing material having a significant volume of air within resilient stuffing fibers to enable the stuffing material to fill out the desired normal shape of the figure and maintain a soft cuddly figure, but be sufficiently transformable to enable the reshaping the figure in various desired ways having play value, and then resiliently resuming the normal shape.

Another object of the present invention is to provide a stuffed animal figure with a highly resilient compressible stuffing material having a significant volume of air within resilient stuffing fibers to enable the figure to be compressed flat or compressed in various ways to reduce the volume of the figure sufficiently to enable the figure to be stuffed into a pocket or purse or other confined space and then resiliently assume its original soft cuddly shape upon release.

One more object of the present invention is to provide a stuffed animal figure with the above described stuffing material and further provide a highly elasticized outer material housing the stuffed material and forming the outer surface of the figure with the outer material stitched together with highly elasticized thread or glue or other stretchable material, enabling the figure to be stretched, by pulling or by other means to create tension, significantly longer, to two, three, or more times its original length, and twisted, stretched around objects, or otherwise transformed in shape, thus enhancing its play value, and then resiliently return to its original shape upon release of the tension force.

An additional object of the present invention is to provide a stuffed animal figure having the above described stuffing with an additional internal elongated strip, formed of thin resilient metal or plastic or other resilient material having a "memory" for assuming a rolled up configuration, but capable of being straightened out and fixed in a rigid straight configuration by snapping the strip at each end to for a crimp in the strip along its entire length to maintain the strip in a rigid straight configuration, enabling the figure to be maintained in a rigid straight posture or rolled up into a circular ring configuration for wrapping around objects, for rolling, for placement in small spaces, or for other uses increasing its play value.

A further object of the present invention is to provide a pair of mutually engageable components on at least two extremities of the stuffed figure so that the stuffed figure is capable of being stretched around an external object and the pair of mutually engageable components, such as mating hook and loop fasteners marketed under the VELCRO® brand name, are capable of being interconnected so that the stuffed animal is retained around the external object until the pair of mutually engageable components are disengaged.

A related object of the present invention is to provide a stuffed figure with a two-sided hook and loop fastener, having one side with a hook surface and the other side with a loop surface, attached to each of the extremities of the stuffed animal so that each of the extremities may be removably attached to any of the other of the extremities.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

In FIGS. 1–14 a shape transformable stuffed toy figure 20A, 20B, and 20C comprises an outer covering 21 and 21A of malleable material, which may have a plush texture 23, forming a continuous exterior surface of the transformable stuffed figure which may be formed with appendages and facial features to resemble an imagined animal creature, such as a space animal, and inside the malleable material, a stuffing material 22 formed of resilient threads of soft fiber spun in curved shapes forming nested balls with a continuous air space 24 between the threads of soft fiber, such as Dupont Comforel®. The threads of soft fiber preferably contain 90% air space 24 between the fibers and are capable of being transformed in shape by an applied force and capable of returning to their original shape upon removal of the applied force.

As seen in FIGS. 1, 3, 5, 6, 10, and 13, the stuffing material 22 is contained by the outer covering 21 and 21A in a static condition with no compression of the threads of soft fiber from their original curved shapes so that the nested balls maintain the same continuous air space 24 between the threads of soft fiber within the outer covering as the nested balls maintain when they are outside the outer covering in their formed shape, so that the stuffed animal figure is capable of being transformed in shape by an applied force, and capable of returning to its original shape due to a transformation of the shape of the stuffing material and the characteristic built-in memory of the stuffing material to return to its original shape upon removal of the applied force.

Figure 1:
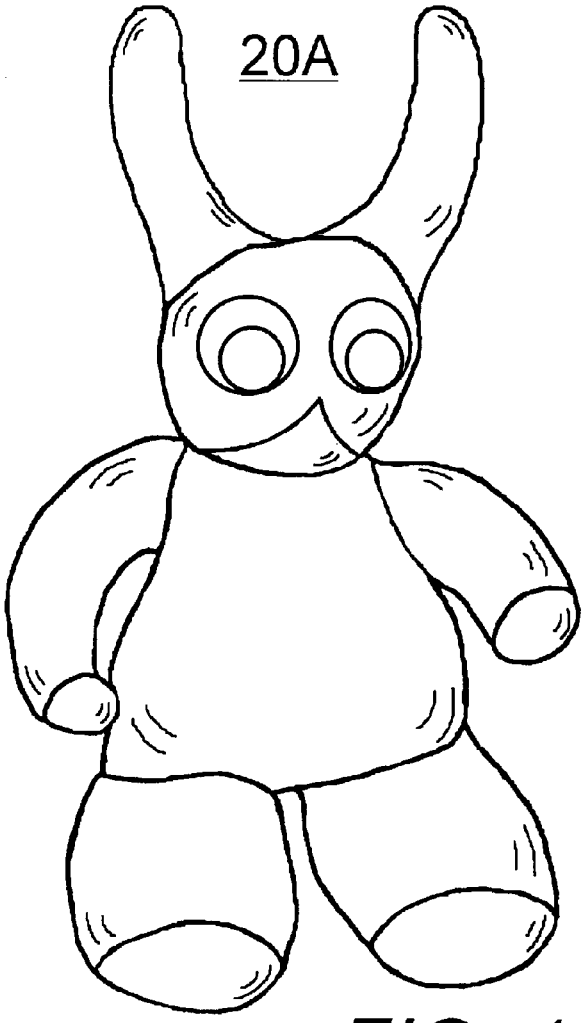
FIG. 1 is a perspective view showing a compressible stuffed toy figure capable of being compressed into a smaller volume.
Figure 2:
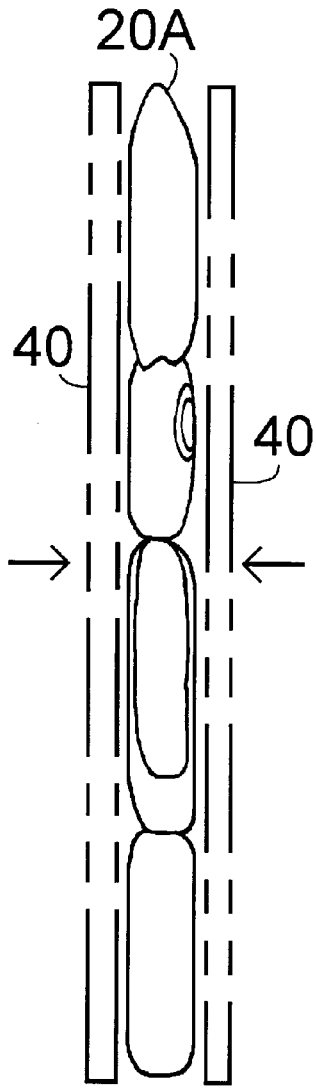
FIG. 2 is a side elevational view of the compressible stuffed toy of FIG. 1 shown compressed flat between two planar surfaces.
Figure 3:
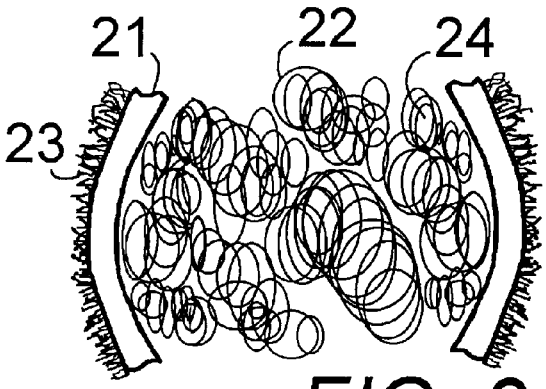
FIG. 3 is a cross-sectional view showing the resilient air-filled stuffing and outer covering material of the compressible stuffed toy.
Figure 4:
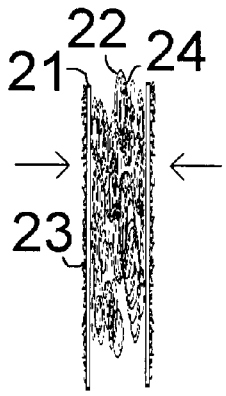
FIG. 4 is a cross-sectional view showing the compression of the resilient air-filled stuffing with most of the air removed by the compression.
Figure 5:
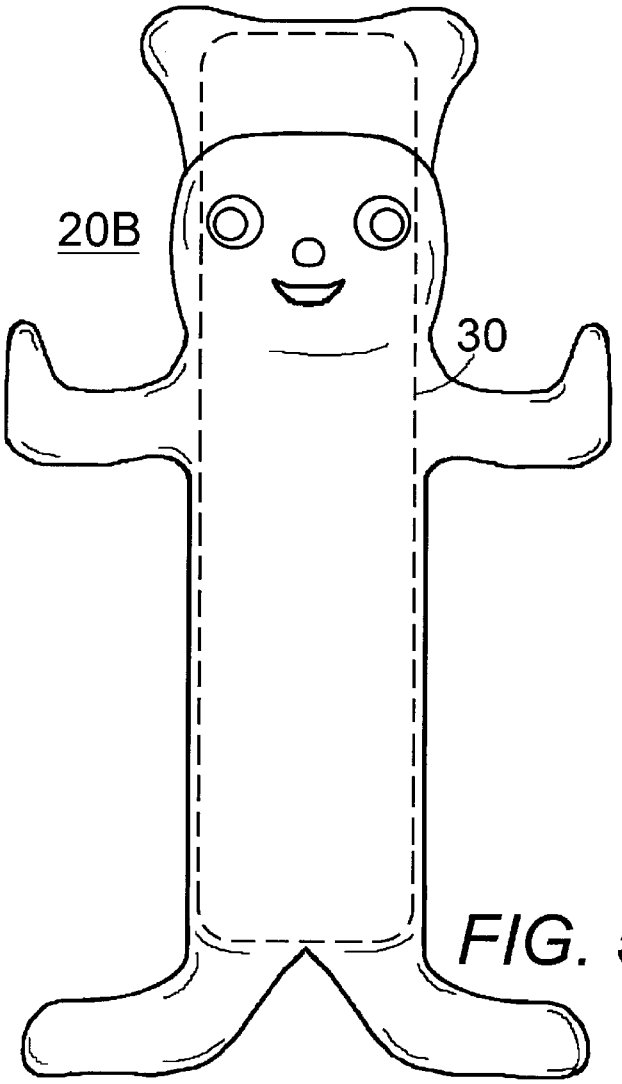
FIG. 5 is a front elevational view showing a roll-up stuffed toy figure capable of being rolled up into a circular configuration and straightened into a rigid straight configuration, which is the configuration illustrated.
Figure 6:
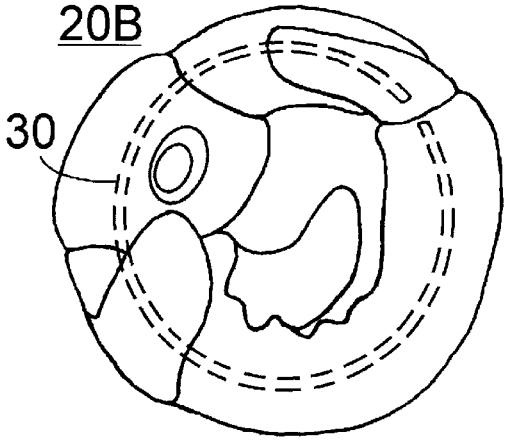
FIG. 6 is a side elevational view showing the roll-up stuffed toy figure in the rolled up circular configuration.
Figure 7:
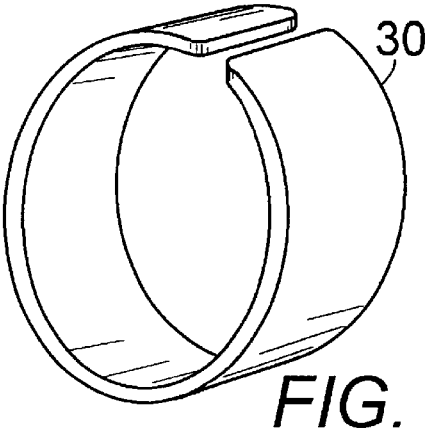
FIG. 7 is a perspective view showing the elongated dual-configuration insert of the roll-up stuffed toy figure with the insert in the rolled up circular configuration.
Figure 8:
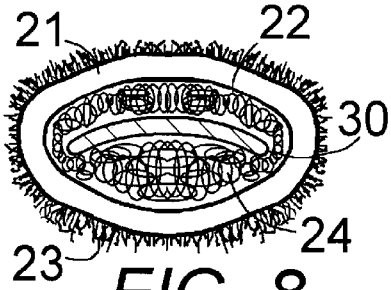
FIG. 8 is a cross-sectional view showing the resilient air-filled stuffing and the dual-configuration insert within the covering material of the roll-up stuffed toy figure.
Figure 9:
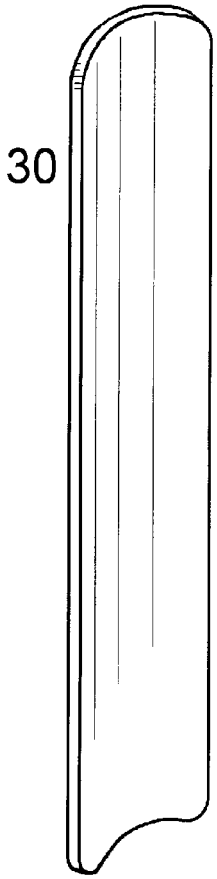
FIG. 9 is a perspective view showing the elongated dual-configuration insert of the roll-up stuffed toy figure with the insert in the rigid straight configuration.

When a compressive force is applied to the stuffed toy, as in FIG. 2, the air is compressed out of the stuffing material 22 and the compressible outer covering material 21 compressed, as seen in FIG. 4 to transform the shape of the stuffed toy. In this embodiment it is a compressible stuffed toy 20A capable of being compressed up to 90% of its volume inside a pocket, pack, book, purse, or any other confined space occupying a smaller volume due to the compressibility of the stuffed animal. Upon release of the compressing force the stuffing material 22 automatically returns to its original shape returning the stuffed toy to its original shape with the original amount of air therein.

In FIGS. 5–9 a roll-up stuffed toy comprises an additional internal elongated strip 30 positioned within the outer covering 21 along with the stuffing material 22 for at least a portion of the length of the stuffed figure. The strip 30 is formed of thin resilient material, such as a springlike metal or a springlike plastic, normally positioned in a rolled up ring configuration, as in FIGS. 6 and 7, but capable of being straightened out and fixed in a rigid straight configuration, is in FIGS. 5 and 9, by snapping the strip at each end to form a crimp in the strip along its entire length to maintain the strip in a rigid straight configuration having an arched transverse section, enabling the figure to be maintained in a rigid straight posture, as in FIG. 5, or rolled up into a circular ring configuration, as in FIG. 6, for wrapping around objects, for rolling, for placement in small spaces, and for other uses increasing its play value.

Figure 10:
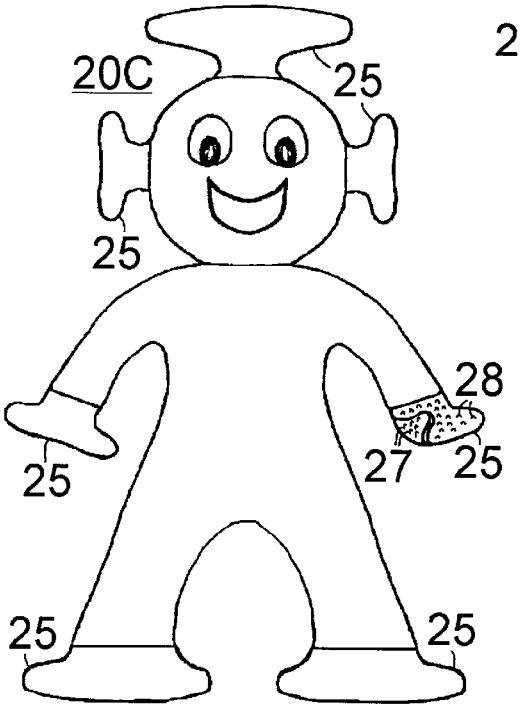
FIG. 10 is a front elevational view of a stretchable stuffed toy figure capable of being stretched and having extremities capable of being removably connected together.
Figure 11:
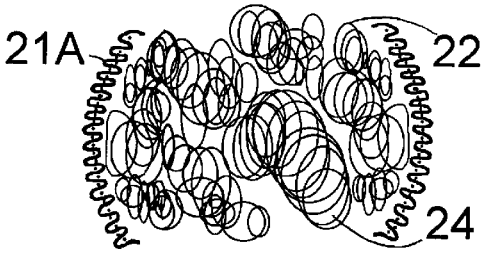
FIG. 11 is a cross-sectional view showing the resilient air-filled stuffing and outer stretchable covering material of the stretchable stuffed toy.
Figure 12:
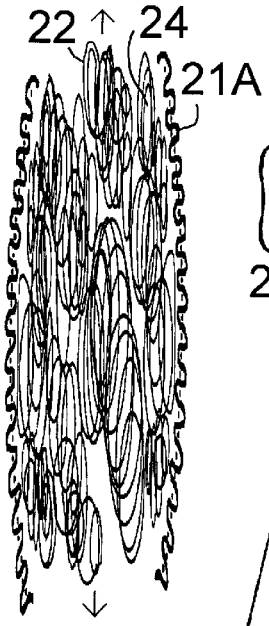
FIG. 12 is a cross-sectional view showing the resilient air-filled stuffing with much of the air compressed out of it and the outer stretchable covering material of the stretchable stuffed toy stretched out compressing the stuffing.
Figure 14:
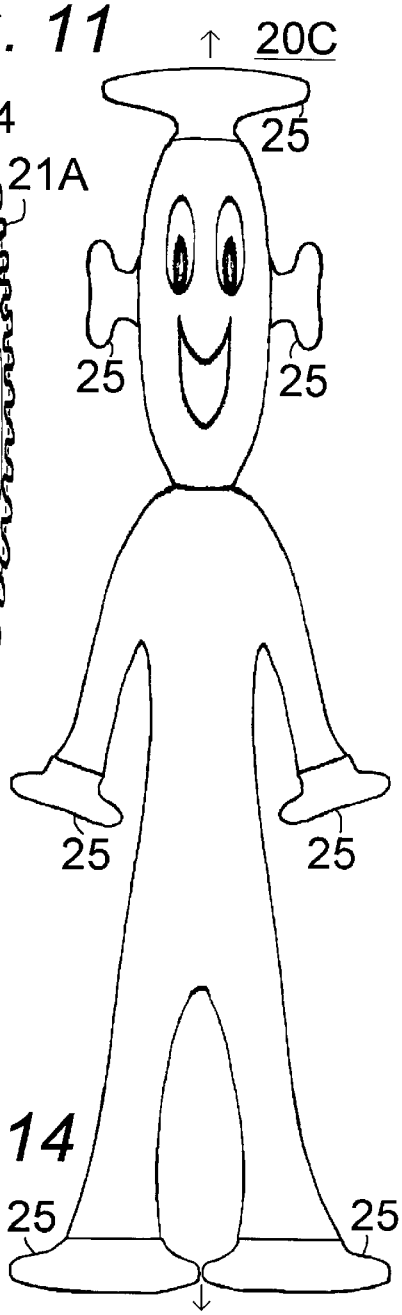
FIG. 14 is a front elevational view of the stretchable stuffed toy figure in the stretched configuration.

In FIGS. 10–14, a stretchable stuffed toy 20C comprises having the malleable material of the outer covering an elasticized material 21A capable of being stretched (up to three times its original length) and the stuffed figure is capable of being stretched by an applied force into an elongated shape, as seen in FIG. 14 and capable of returning to its original shape upon removal of the applied force, as seen in FIG. 10. As seen in FIG. 12 the elasticized material 21A is stretched and the stuffing material 22 is elongated longitudinally and compressed laterally reducing the air space 24 therein. Upon releasing the stretching force the elasticized material 21A and the stuffing material 22 relax back to their original shape with the original amount of air space, as seen in FIG. 11.

Figure 13:
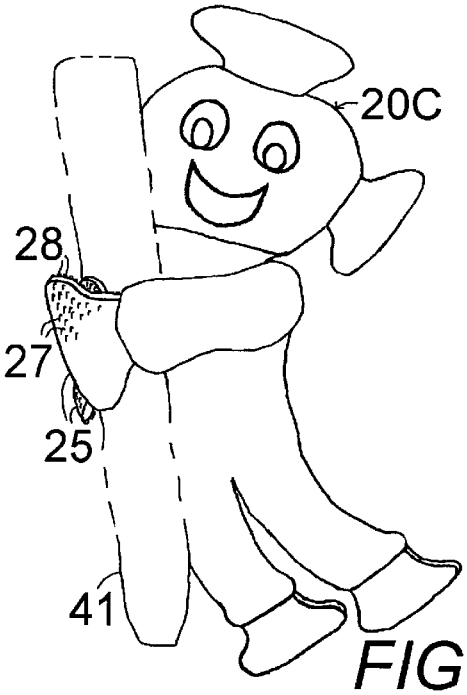
FIG. 13 is a front elevational view showing the stretchable stuffed toy figure with upper limbs stretched around an external object and the extremities interconnected around the object.
Figure 15:
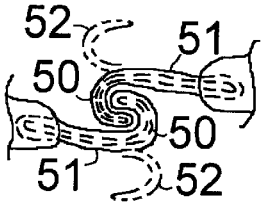
FIG. 15 is a partial elevational view showing mating hooks on two of the extremities of the stretchable stuffed toy figure.

The stretchable stuffed toy 20C further comprises a pair of mutually engageable components 25, such as two-sided mating hook 27 and loop 28 fastener material (such as VELCRO®) on at least two extremities of the stuffed figure so that the stuffed figure is capable of being stretched around an external object 41 and the pair of mutually engageable components 25, in this case the "hands" of the stuffed toy, are capable of being interconnected so that the stuffed animal is retained around the external object, as in FIG. 13, until the pair of mutually engageable components are disengaged. Preferably the "hands", "feet", "ears", and top of the head are all double sided VELCRO®, with the hook surface 27 on one side and the loop surface 28 on the other side, as seen in FIGS. 10 and 13, so that any of the mutually engageable components 25 on the extremities is capable of engaging any other one. Alternately, in FIG. 15 the pair of mutually engageable components comprises a pair of mating hooks 50 which may be covered by material 52. They may be two-sided hooks 51 as indicated by the exterior dashed lines. The pair of mating hooks are preferably fabricated of a rigid material such as metal or hard plastic.

It is understood that the preceding description is given merely by way of illustration and not in limitation of the invention and that various modifications may be made thereto without departing from the spirit of the invention as claimed.

What is claimed is:

1. A shape transformable stuffed figure comprising:

an outer covering of malleable material forming a continuous exterior surface of the transformable stuffed figure;

a stuffing material formed of resilient threads of soft fiber spun in curved shapes forming nested balls with a continuous air space between the threads of soft fiber, the threads of soft fiber capable of being transformed in shape by an applied force and capable of returning to their original shape upon removal of the applied force, the stuffing material being contained by the outer covering in a static condition with no compression of the threads of soft fiber from their original curved shapes so that the nested balls maintain the same continuous air space between the threads of soft fiber within the outer covering as the nested balls maintain when they are outside the outer covering in their formed shape, so that the stuffed animal figure is capable of being transformed in shape and capable of returning to its original shape due to a transformation of the shape of the stuffing material.

2. The stuffed figure of claim 1 wherein the continuous air space between the threads of soft fiber comprises at least ninety percent by volume of the nested balls.

3. The stuffed figure of claim 2 wherein the malleable material of the outer covering is a resilient material capable of being compressed and the stuffed figure is capable of being compressed by an applied force into a shape at least ninety percent less by volume than the stuffed animal with the applied force removed and capable of returning to its original shape upon removal of the applied force.

4. The stuffed figure of claim 2 wherein the malleable material of the outer covering is an elasticized material capable of being stretched and the stuffed figure is capable of being stretched by an applied force into an elongated shape and capable of returning to its original shape upon removal of the applied force.

5. The stuffed figure of claim 4 further comprising a pair of mutually engageable components on at least two extremities of the stuffed figure so that the stuffed figure is capable of being stretched around an external object and the pair of mutually engageable components are capable of being interconnected so that the stuffed animal is retained around the external object until the pair of mutually engageable components are disengaged.

6. The stuffed figure of claim 5 wherein the pair of mutually engageable components comprise a mating pair of hook and loop fasteners.

7. The stuffed figure of claim 6 wherein a two-sided hook and loop fastener having one side with a hook surface and the other side with a loop surface is attached to each of the extremities of the stuffed animal so that each of the extremities may be removably attached to any of the other of the extremities.

8. The stuffed figure of claim 5 wherein the pair of mutually engageable components comprise a mating pair of hooks.

9. The stuffed figure of claim 2 further comprising an additional internal elongated strip positioned within the outer covering along at least a portion of the length of the stuffed figure, the strip formed of thin resilient material normally positioned in a rolled up ring configuration, but capable of being straightened out and fixed in a rigid straight configuration by snapping the strip at each end to form a crimp in the strip along its entire length to maintain the strip in a rigid straight configuration, enabling the figure to be maintained in a rigid straight posture or rolled up into a circular ring configuration for wrapping around objects, for rolling, for placement in small spaces, and for other uses increasing its play value.

10. The stuffed figure of claim 9 wherein the internal elongated strip is formed of a springlike metal.

11. The stuffed figure of claim 9 wherein the internal elongated strip is formed of a springlike plastic.

* * * * *